US010309115B2

(12) United States Patent
Barraclough

(10) Patent No.: US 10,309,115 B2
(45) Date of Patent: Jun. 4, 2019

(54) LIFTING ANCHORS

(71) Applicant: ILLINOIS TOOL WORKS INC., Glenview, IL (US)

(72) Inventor: Andrew Saul Barraclough, Victoria (AU)

(73) Assignee: Illinois Tool Works Inc., Glenview, IL (US)

( * ) Notice: Subject to any disclaimer, the term of this patent is extended or adjusted under 35 U.S.C. 154(b) by 52 days.

(21) Appl. No.: 14/396,812

(22) PCT Filed: Apr. 25, 2013

(86) PCT No.: PCT/US2013/038159
§ 371 (c)(1),
(2) Date: Oct. 24, 2014

(87) PCT Pub. No.: WO2013/163390
PCT Pub. Date: Oct. 31, 2013

(65) Prior Publication Data

US 2015/0075090 A1 Mar. 19, 2015

(30) Foreign Application Priority Data

Apr. 26, 2012 (AU) ..... 2012901633

(51) Int. Cl.
*E04G 21/14* (2006.01)

(52) U.S. Cl.
CPC ..... *E04G 21/147* (2013.01); *E04G 21/142* (2013.01)

(58) Field of Classification Search
CPC ..... E04G 32/142; E04G 32/147
(Continued)

(56) References Cited

U.S. PATENT DOCUMENTS 4,173,856 A 11/1979 Fricker
7,934,343 B2 5/2011 Fletcher et al.
(Continued)

FOREIGN PATENT DOCUMENTS

AU 2006201337 A1 10/2006
EP 1712705 A2 10/2006
WO 2011006189 A1 1/2011

OTHER PUBLICATIONS

ISR and WO for PCT/US2013/038159 dated Aug. 29, 2013.

*Primary Examiner* — Charles A Fox
*Assistant Examiner* — James Buckle, Jr.
(74) *Attorney, Agent, or Firm* — Neal, Gerber & Eisenberg LLP

(57) ABSTRACT

An edge lift anchor for embedment into a concrete panel, the anchor having a head of generally plate-like form for releasable attachment with lifting equipment, and at least one leg extending from the head, for locking into the surrounding concrete, the head having an eye for receiving a locking bolt of a lifting clutch in the form of a ring clutch, the head having an upper edge engageable by the body of the ring clutch when the clutch body is inclined at the commencement of lifting a cast panel from the horizontal configuration in which it is cast to a generally vertical configuration, wherein the width of the head is such that engagement between the clutch body and the edge of the head at the commencement of lifting from a horizontal configuration is at a sufficient distance from the end of the head that any deformation of the edge of the head caused by engagement with the clutch body under the applied lifting load will be wholly contained within the width of the head.

22 Claims, 5 Drawing Sheets

(58) Field of Classification Search
USPC ..... 52/125.2, 125.4, 125.5; 411/451.1, 452; 294/82.1, 92, 901
See application file for complete search history.

(56) References Cited

U.S. PATENT DOCUMENTS

| | | | | |
|---|---|---|---|---|
| 8,746,770 | B2 * | 6/2014 | Sladojevic | 294/215 |
| 2006/0248813 | A1 * | 11/2006 | Fletcher et al. | 52/125.4 |
| 2008/0196324 | A1 | 8/2008 | Mackay Sim | |
| 2013/0097945 | A1 * | 4/2013 | Sladojevic | 52/125.4 |
| 2013/0139451 | A1 * | 6/2013 | Sladojevic | 52/125.4 |

* cited by examiner

LIFTING ANCHORS

RELATED APPLICATIONS

The present application is a National Phase of International Application Number PCT/US2013/038159 filed Apr. 25, 2013 which claims priority of Australian Application Number 2012901633 filed Apr. 26, 2012.

The present invention relates to lifting anchors to be incorporated into concrete components during casting thereof to provide lifting points by which the component can be lifted and more particularly to edge lift anchors for incorporation into concrete panels.

One type of edge lift anchor for use with concrete panels comprises a head configured for engagement with a lifting clutch and opposed generally parallel legs extending from the head to provide anchorage within the panel, the legs being appropriately profiled along their edges for that purpose. Various different designs of this type of anchor are in widespread use. Edge lift anchors of this type are currently formed by cutting from thick metal plate using non-contact high energy cutting means such as a laser beam or plasma arc with the edges of the legs being profiled in this cutting process.

The preferred embodiment to be described herein features a range of improvements in edge lift anchors of the general type discussed above. The present invention in its preferred embodiment relates to improvements in the design of the head of anchors of the type discussed above.

According to the present invention there is provided an edge lift anchor for embedment into a concrete panel, the anchor having a head of generally plate-like form for releasable attachment with lifting equipment, and at least one leg extending from the head, for locking into the surrounding concrete, the head having an eye for receiving a locking bolt of a lifting clutch in the form of a ring clutch, the head having an upper edge engageable by the body of the ring clutch when the clutch body is inclined at the commencement of lifting a cast panel from the horizontal configuration in which it is cast to a generally vertical configuration, wherein the width of the head is such that engagement between the clutch body and the edge of the head at the commencement of lifting from a horizontal configuration is at a sufficient distance from the end of the head that any deformation of the edge of the head caused by engagement with the clutch body under the applied lifting load will be wholly contained within the width of the head.

In an advantageous embodiment the width of the head is such that engagement of the clutch body with the edge of the head at the commencement of lifting from the horizontal configuration takes place at a distance of between about 12 mm and 16 mm from the end of the edge.

An embodiment of the invention will now be described by way of example only with reference to the accompanying drawings in which.

Figure 6:
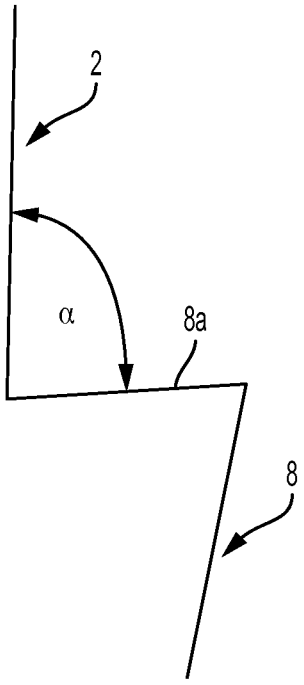
Figure 7:
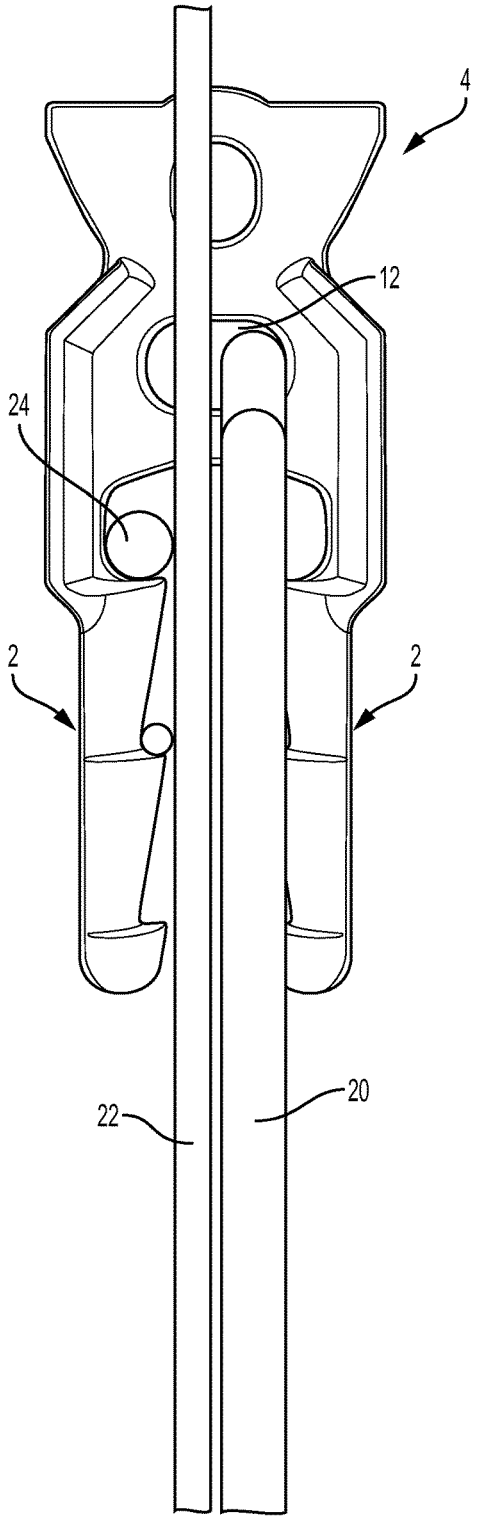
Figure 8:
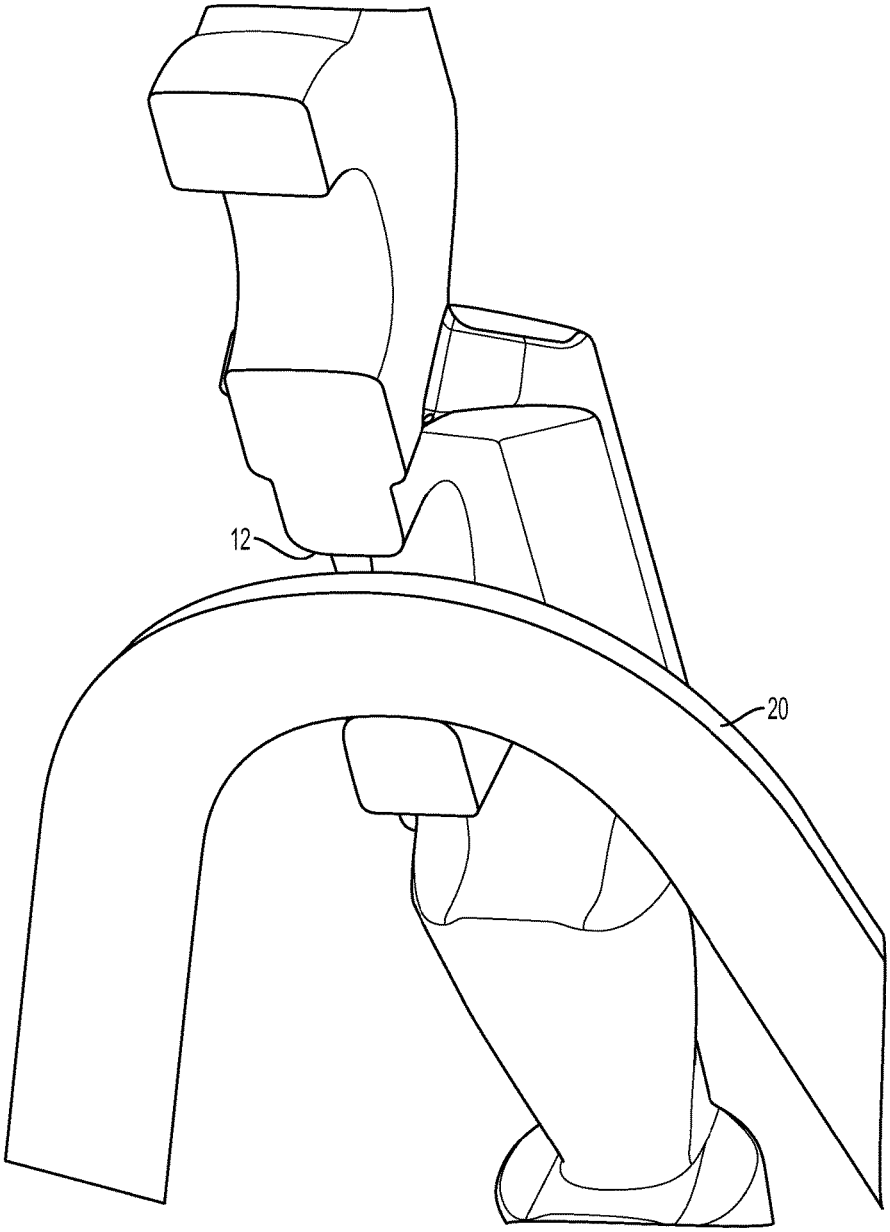

FIG. 6 is a schematic enlarged view to illustrate the inclination of the operative face of each anchoring formation on the respective legs of the anchor; and FIG. 7 illustrates the co-operation between the anchor, a tension bar, central mesh, and a perimeter bar prior to casting; and FIG. 8 is a fragmentary sectional enlarged view illustrating the co-operation between the tension bar and an arcuate upper edge of the tension bar aperture in the anchor head.

The preferred embodiment of the anchor now to be described herein incorporates a range of improvements over prior anchors of the type previously discussed. While this application is particularly directed to improvements to the design of the anchor head, it should be understood that other improvements are the subject of co-pending applications of even date.

The edge lift anchor shown in the accompanying drawings is of the same general form as that described in Australian patent application 2006201337 of Cetram Pty Ltd (a subsidiary of the present applicants) and comprises a pair of opposed parallel legs 2 extending from a head 4. The particular head shown is designed for use with a releasable lifting clutch in the form of a ring clutch having an arcuate locking bolt received within an eye 6 in the head. The legs 2 are profiled with a series of saw-toothed formations 8 along their length. While the saw-toothed formations are similar to those described in detail in the aforesaid application and have a corresponding locking effect with the surrounding concrete when the anchor is under tensile load, there are differences as will be described subsequently.

In contrast to the anchor of the aforesaid application and which is cut from thick metal plate, the anchor of the preferred embodiment is fabricated by other techniques such as hot drop forging from a metal billet (the particularly preferred method), casting, or sintering. Not only does this lead to reduced manufacturing costs, it permits a range of significant design changes providing benefits such as increased anchor capacity and performance which in turn can enable a further manufacturing cost reduction for a given capacity of anchor and benefits in the installation of the anchor. In this respect it is to be noted that with edge lift anchors of the type in question cut from thick metal plate any design changes are predominantly confined to the configuration of the cut edges of the anchor while the opposed faces of the anchor which are formed out of the opposed faces of the plate are fundamentally planar. However by using other techniques as just indicated, shaping can be applied to all parts of the anchor including its opposed faces in order to provide desired technical/functional effects, as will now be described.

Figure 1:
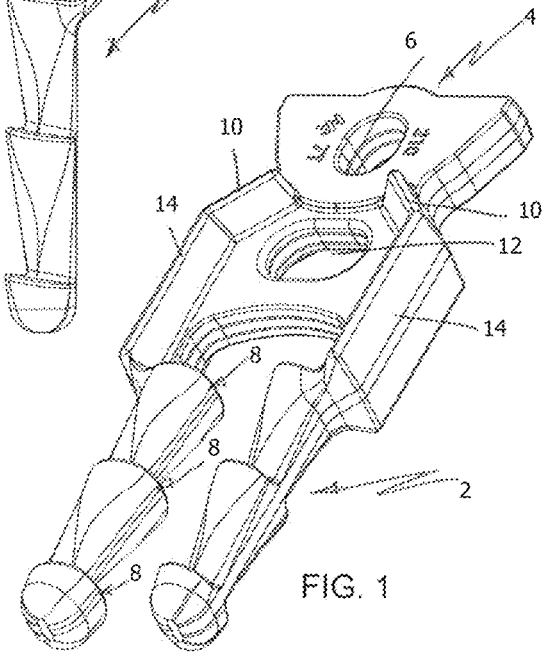
FIG. 1 is a perspective view of an edge lift anchor in accordance with the preferred embodiment of the invention.
Figure 4:
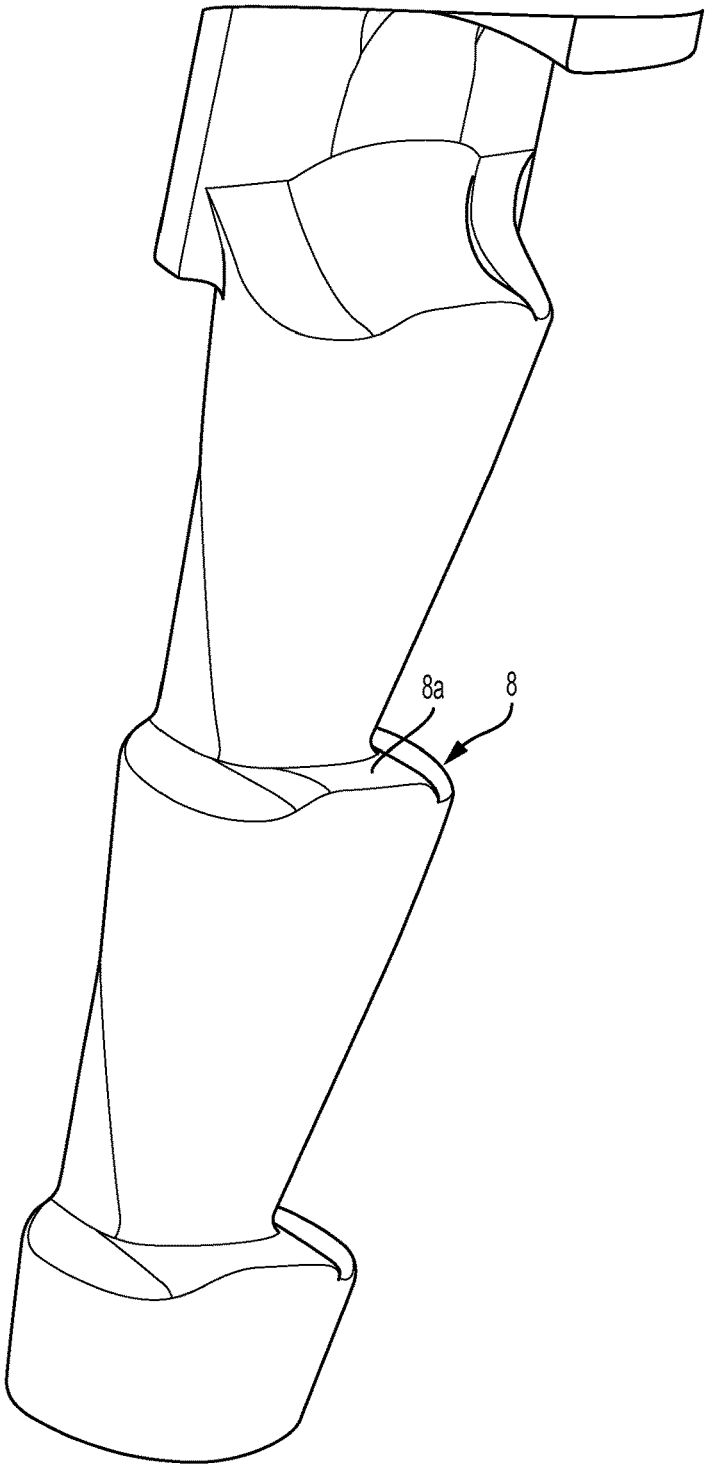
FIG. 4 is a fragmentary enlarged view showing in detail locking formations on each of the legs of the anchor.
Figure 5:
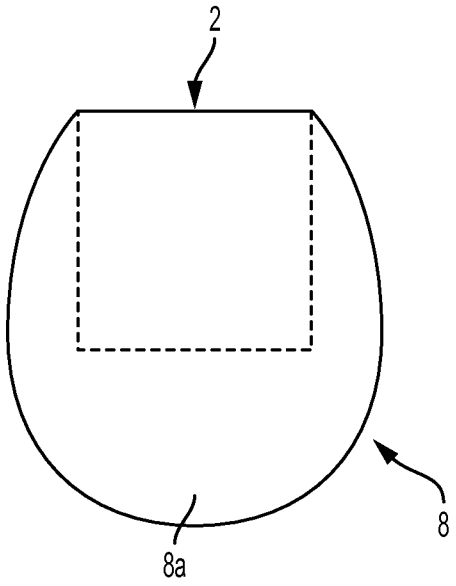
FIG. 5 is a section on line A-A of FIG. 2.

Although, as mentioned above, the legs of the preferred embodiment are formed with a series of generally saw-toothed formations along their length as generally described in the aforesaid application, in the preferred embodiment the formations 8 do not extend just along the inner edges of the legs as occurs with an anchor cut from thick metal plate, but they also extend onto the opposed faces of each leg as will be apparent from FIGS. 1 and 4. This increases the mechanical interlock with the surrounding concrete and increases the concrete capacity. In practice, the area of engagement between the upper inclined face 8*a* of each formation, and which is the operative face when the anchor is under tensile load, may be almost double that of a comparable anchor cut from metal plate. This in turn allows the length of the legs to be reduced for a given anchor capacity and hence enables a reduction in material costs. It is to be noted that whereas in the aforesaid application, the upper operative face of the formation is shown at a relatively "steep" angle of inclination and which is easily achievable by the cutting methods used, manufacture by hot drop forging is unlikely to achieve that. However it can achieve an upwards inclination of up to about 5° (corresponding to an acute angle α of 85° to the longitudinal axis of the leg) and that is still sufficient to provide the interlocking effects described in the aforesaid application.

It is to be noted that when hot drop forging is used to manufacture the anchor, due to the manner in which the forging tool closes onto the billet it is not possible for the entire upper operative face of the formation to achieve the desired upwards inclination and in practice this is achievable only in the portion adjacent the inner edge of the leg whereas the portions of the upper face adjacent the opposed faces of the leg will either be at right angles to the axis of the leg or feature a slight downwards inclination. This transformation in the inclination of the upper operative face can be seen in FIG. 4. Nevertheless the central portion of the upper operative face which is able to achieve the desired upwards inclination leads to the positive locking effects previously discussed whereas the outer portions of the face which do not, still have beneficial effect in increasing the area of engagement of the formation with the surrounding concrete and increases the concrete capacity. However, if other manufacturing techniques such as casting or sintering are used to manufacture the anchor it should be possible to achieve the desired upwards inclination over the entire surface of the formation.

In the upper part of the anchor immediately below the head 4 which is engaged by the ring clutch, the anchor is formed on each of its two opposed faces with inclined ribs 10 adjacent the respective edges of the anchor. In the embodiment shown, the ribs 10 are inclined at approximately 45° to the longitudinal axis of the anchor. These ribs act to increase the rigidity of the anchor in that zone and which is of particular utility when the anchor has in that zone an aperture 12 beneath the head for receiving a tension bar which is bent into a generally V-shaped configuration as is well known. This is of relevance in the initial phases of lifting the panel from the horizontal configuration in which it is cast to a generally vertical configuration. The ribs 10 also provide improved interlock with the surrounding concrete during these initial lifting phases. Longitudinal extensions 14 of the inclined ribs along each of the opposed edges of the anchor provide shear capacity during the initial phases of lifting from the horizontal to the generally vertical thereby obviating the need for the installer to incorporate shear bars for that purpose.

It will be noted that in the embodiment shown, the aperture 12 for the tension bar is of elongate form transversely of the longitudinal axis of the anchor, whereas in existing anchors of this type when such an aperture is present it is of circular form. This elongation enables the tension bar to be placed slightly "off centre" with respect to the panel while extending throughout its length substantially parallel to central reinforcing mesh within the panel and hence substantially parallel to the longitudinal axis of the anchor, it being understood that the length of the aperture is sufficient for that purpose. This is illustrated in FIG. 7 in which the tension bar is shown at 20, and the central mesh at 22. In contrast, with a centrally placed circular aperture for that purpose, the tension bar needs to be tilted in order to avoid the mesh and when the panel itself is relatively thin and the tension bar relatively long, the tilt can cause the remote ends of the bar to approach close to the surface of the panel. With the ability to place the tension bar "off centre" and also due to the presence of the longitudinal extensions 14 of the ribs which extend to the zone of the uppermost locking formations 8, the thickness of the legs 2 can be reduced in that area to provide an enlarged space into which a perimeter bar 24 could fit as shown in FIG. 7. The reduced leg thickness in that zone does not compromise the strength of the legs as a consequence of the presence of the reinforcement which is provided by the longitudinal rib extensions in that zone.

It is to be understood that a tension bar aperture of elongate form as discussed above could also be used in conventional plate cut anchors. While reinforcement could not then be provided by the use of integral reinforcing ribs although it could be provided by ribs separately formed and welded to the plate, sufficient reinforcement could be provided within the structure of the plate itself by increasing the width of the cut anchor in the zone of the aperture.

Advantageously, the lower surface of the tension bar aperture 12 is arcuate in transverse section with a curvature which matches the curvature of the bent apex of the tension bar as shown schematically in FIG. 8. Whereas in an anchor cut from metal plate the lower surface of the tension bar aperture is substantially linear in transverse section whereby the apex of the bent tension bar will just engage the edge portions of the aperture, by shaping the surface in the manner just described the apex of the tension bar engages the aperture over an increased area and reduces the shear component on the bar when under load. The consequence of this is the bar will yield at a higher loading and this enables a possible reduction in bar diameter for a given loading.

In existing anchors, the width of the head and which corresponds to the overall width of the anchoring portion defined by the two legs is such that when the lifting clutch is inclined at the start of lifting a panel from the horizontal configuration in which it is cast to a generally vertical configuration, the clutch body abuts against the upper edge of the head thereby blocking rotation of the clutch body beyond that point to prevent damage to the surrounding concrete of the panel. However, in existing anchors that engagement tends to occur very close to the end of the upper edge and that may result in some deformation of the head at that point when the anchor is under a loading close to its maximum loading. This deformation at the end of the edge can sometimes result in cracking of the surrounding concrete to which the edge of the head is immediately adjacent. In the preferred embodiment the width of the head is increased to provide an increased length of the upper edge whereby the clutch body when inclined will engage that edge at a position displaced more inwardly from the outer end of the edge. In particular the width is increased to permit engagement of the clutch body with the edge at a distance of approximately 12 to 16 mm from the end of the edge, depending on anchor and clutch capacity. In this regard, edge lift anchors are typically produced with lifting capacities of 3, 7, and 10 tonnes for use with lifting anchors of corresponding rating. Clutch bodies of typical lifting clutches within these ranges have a thickness of from around 48 to 55 mm and engagement of the clutch body with the anchor head at a point displaced inwardly from the end by a distance of the order indicated above can be achieved by producing a 3 tonne anchor with a head width of about 50 to 65 mm, 7 tonne capacity with a width of about 70 to 85 mm, and 10 tonne capacity with a width of about 75 to 90 mm. In one practical example, a 3 tonne anchor has a head width of 60+/−1 mm, a 7 tonne anchor has a head width of 80+/−1 mm, and a 10 tonne anchor has a head width of 85+/−1 mm. As the increased head width is for the purpose of achieving engagement with the clutch body by a greater distance displaced inwardly from the end it is not essential for the whole of the head to be of that width and in the preferred embodiment the head narrows inwardly from its widened upper edge in order to provide reduced material costs. That narrowing, although desirable for reasons just mentioned, is not essential from a functional perspective. With the increased head width, the diameter of the void formed in the edge of the concrete panel during casting and within which the head sits, is commensurately increased in diameter by using a void former of related size so that the edges of the head are immediately adjacent the concrete.

It is to be understood that this development in head sizing could equally be applied to anchors cut from metal plate to achieve the benefits just described.

The embodiment has been described by way of example only and modifications are possible within the scope of the invention. For example although it is preferred for the anchor to have two parallel profiled legs extending from the head, it is in principle feasible for the anchor to have only a single such leg with the profiling on three sides of the leg or even on all four sides of the leg so as to interlock with the surrounding concrete. As an alternative to the production methods described herein, the anchor could be fabricated by machining from a single piece of metal or assembled from several separate components by welding together.

The manufacturing techniques discussed herein as an alternative to cutting from thick metal plate permit a variety of 3-D shaping options not achievable by the plate cutting technique previously used. As regards the leg or legs of the anchor although shaping with anchoring formations along opposed faces and the edge is preferred, depending on the technical requirements of the anchor it is possible to have the shaping just along the opposed faces or perhaps even along just one of the opposed faces.

It is to be understood that terms such as "upper" and "lower" and similar terms as used in the following claims and elsewhere in the specification are relative terms in relation to the configuration of the anchor when in a lifting state when the anchor and panel in which it is embedded are substantially vertical.

Figure 3:
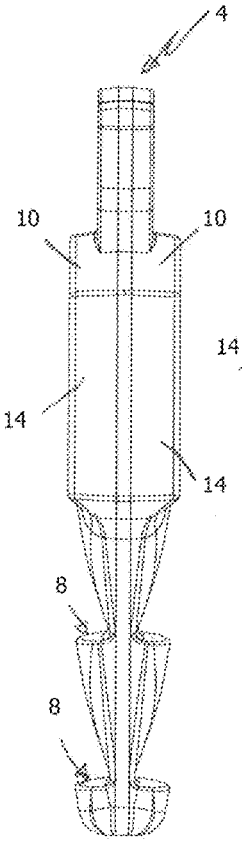
FIG. 3 is a view of the anchor from one edge (view from opposite edge corresponds)
Figure 2:
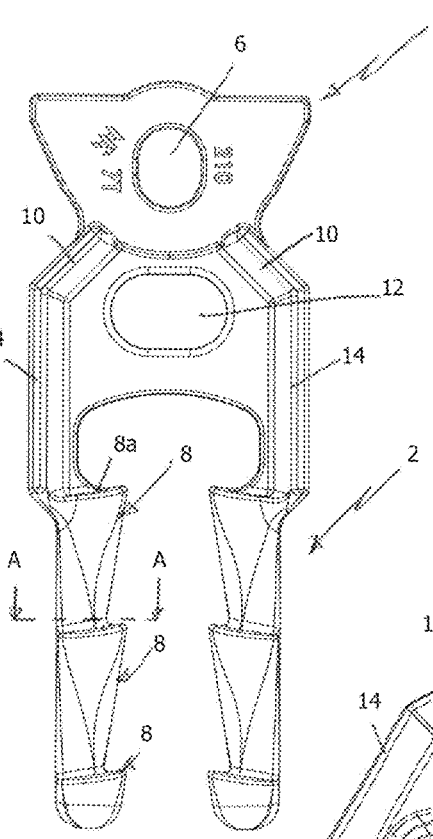
FIG. 2 is a view of the anchor from one face (view from opposite face corresponds)

In an embodiment shown best in FIGS. 2 and 7, the head 4 includes (i) an indentation formed from a first inwardly tapered portion having a wide end and a narrow end, and a second inwardly tapered portion having a wide end and a narrow end, wherein the wide end of the first inwardly tapered portion extends from a first end of the head 4 including the upper edge, and wherein the narrow end of the second inwardly tapered portion extends from the narrow end of the first inwardly tapered portion, and (ii) a third inwardly tapered portion extending from the head 4 to the at least one leg 2.

The claims defining the invention are as follows:

1. An edge lift anchor for embedment into a concrete panel the edge lift anchor comprising:

a head configured to be releasably attached to lifting equipment; and at least one leg extending from the head and configured to be locked into surrounding concrete of the concrete panel, the head having:

an eye configured to receive a locking bolt of a lifting clutch in the form of a ring clutch; and an upper edge engageable by a body of the ring clutch when the body of the clutch is inclined at the commencement of lifting a cast concrete panel from a horizontal configuration in which it is cast to a generally vertical configuration;

wherein the head (i) defines an indentation formed by a first inwardly tapered portion having a wide end and a narrow end, and a second inwardly tapered portion having a wide end and a narrow end, wherein the wide end of the first inwardly tapered portion extends from a first end of the head, and wherein the narrow end of the second inwardly tapered portion extends from the narrow end of the first inwardly tapered portion, and (ii) includes a third inwardly tapered portion extending from the head toward the at least one leg.

2. The edge lift anchor of claim 1, wherein a width of the first end of the head is such that engagement of the clutch body with the upper edge of the head at the commencement of lifting from the horizontal configuration takes place at a distance of between about 12 mm and 16 mm from a lateral end of the upper edge.

3. The edge lift anchor of claim 1, wherein the anchor has a lifting capacity of 3 tons and a width of the first end of the head is between about 50 mm and 65 mm.

4. The edge lift anchor of claim 1, wherein the anchor has a lifting capacity of 7 tons and the width of the first end of the head is between about 70 mm and 85 mm.

5. The edge lift anchor of claim 1, wherein the anchor has a lifting capacity of 10 tons and the width of the first end of the head is between about 75 mm and 90 mm.

6. An edge lift anchor for embedment into a concrete panel, the edge lift anchor comprising:

a head configured to be releasably attached to lifting equipment, the head having opposite front and back faces;

a rib protruding in a thickness direction of the head beyond both said front and back faces of the head, the rib comprising:

a first section extending from the head obliquely with respect to a longitudinal direction of the anchor; and a second section extending from the first section along the longitudinal direction; and at least one leg extending from the second section along the longitudinal direction, and configured to be locked into concrete surrounding the at least one leg when the lift anchor is embedded in the concrete panel, the head having an eye configured to receive a locking bolt of a lifting clutch, wherein the head includes an upper edge configured to be engageable by a clutch body of the clutch when the clutch body is inclined at a commencement of lifting the concrete panel in which the lift anchor is embedded from a horizontal configuration, in which the concrete panel is cast, to a vertical configuration.

7. The edge lift anchor of claim 6, wherein the edge lift anchor further includes a tension bar aperture.

8. The edge lift anchor of claim 6, wherein the edge lift anchor further includes a tension bar aperture located, relative to the longitudinal direction of the edge lift anchor, between the eye and a beginning of the at least one leg.

9. The edge lift anchor of claim 6, wherein the edge lift anchor further includes a tension bar aperture having a lower surface that is arcuate in transverse section.

10. The edge lift anchor of claim 6, wherein the at least one leg includes a series of generally saw-toothed formations along its length.

11. The edge lift anchor of claim 6, further comprising two legs, wherein respective legs of the two legs include a series of generally saw-toothed formations along the length of the respective legs, where the formations extend along the inner edges of the legs, and extend onto respective opposed faces of the respective legs.

12. The edge lift anchor of claim 6, wherein the edge lift anchor further includes a tension bar aperture that is elongate in a direction transverse to the longitudinal direction of the edge lift anchor.

13. The edge lift anchor of claim 6, wherein the edge lift anchor includes a body made from at least one of drop forging, casting or sintering.

14. The edge lift anchor of claim 6, wherein a majority of the cross-sections taken at constant intervals along the longitudinal direction of the edge lift anchor normal thereto have outer profiles that are complex.

15. The edge lift anchor of claim 6, wherein a majority of the cross-sections taken at constant intervals along the longitudinal direction of the edge lift anchor normal thereto have outer profiles that are non-rectangular.

16. An edge lift anchor configured to be embedded into a concrete panel, the edge lift anchor comprising:

a head configured to be releasably attached to lifting equipment; and at least one leg extending from at least one longitudinal extension of an inclined rib which extends to a zone of uppermost locking formations, the locking formations configured to lock into the surrounding concrete, the head having an eye configured to receive a locking bolt of a lifting clutch in the form of a ring clutch, the head having an upper edge engageable by the body of the ring clutch when the clutch body is inclined at a the commencement of lifting a cast concrete panel from a horizontal configuration in which it is cast to a generally vertical configuration, wherein a width of the head is such that engagement between the clutch body and the upper edge of the head at the commencement of lifting from the horizontal configuration is at a distance from the end of the head that any deformation of the edge of the head caused by engagement with the clutch body under the applied lifting load will be wholly contained within the width of the head.

17. The edge lift anchor of claim 16, wherein the edge lift anchor is embedded in a concrete panel.

18. An assembly comprising:

a concrete panel; and the edge lift anchor of claim 16, wherein the edge lift is embedded in the concrete panel.

19. The edge lift anchor of claim 16, wherein the anchor has a lifting capacity of 3 tons.

20. The edge lift anchor of claim 16, wherein the width of the head is one of:

between about 50 mm and 65 mm;

between about 70 mm and 85 mm; or between about 75 mm and 90 mm.

21. The edge lift anchor of claim 16, wherein the head is flat on a front surface and a back surface of the head, wherein the front and back surfaces are parallel to one another, wherein the front surface and the back surface are normal to an axial direction of the eye.

22. The edge lift anchor of claim 16, wherein the head is a plate having chamfered edges.

* * * * *